US006625576B2

(12) United States Patent
Kochanski et al.

(10) Patent No.: US 6,625,576 B2
(45) Date of Patent: Sep. 23, 2003

(54) METHOD AND APPARATUS FOR PERFORMING TEXT-TO-SPEECH CONVERSION IN A CLIENT/SERVER ENVIRONMENT

(75) Inventors: Gregory P. Kochanski, Dunellen, NJ (US); Joseph Philip Olive, Watchung, NJ (US); Chi-Lin Shih, Berkeley Heights, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/772,300

(22) Filed: Jan. 29, 2001

(65) Prior Publication Data

US 2002/0103646 A1 Aug. 1, 2002

(51) Int. Cl.[7] ..... G10L 13/00
(52) U.S. Cl. ..... 704/260; 704/258
(58) Field of Search ..... 704/260, 207, 704/258, 261, 270; 379/67.1, 88.16, 88.17; 455/413

(56) References Cited

U.S. PATENT DOCUMENTS

| | | | | | |
|---|---|---|---|---|---|
| 3,704,345 | A | | 11/1972 | Coker | 179/1 SA |
| 4,829,580 | A | | 5/1989 | Church | 381/52 |
| 4,872,202 | A | * | 10/1989 | Fette | 704/260 |
| 4,912,768 | A | * | 3/1990 | Benbassat | 704/260 |
| 4,964,167 | A | * | 10/1990 | Kunizawa et al. | 704/260 |
| 4,975,957 | A | * | 12/1990 | Ichikawa et al. | 704/220 |
| 5,283,833 | A | | 2/1994 | Church et al. | 381/41 |
| 5,381,466 | A | * | 1/1995 | Shibayama et al. | 379/88 |
| 5,633,983 | A | | 5/1997 | Coker | 395/2.69 |
| 5,673,362 | A | * | 9/1997 | Matsumoto | 704/260 |
| 5,751,907 | A | | 5/1998 | Moebius et al. | 395/2.76 |
| 5,790,978 | A | | 8/1998 | Olive et al. | 704/207 |
| 5,924,068 | A | * | 7/1999 | Richard et al. | 704/260 |
| 5,933,805 | A | * | 8/1999 | Boss et al. | 704/249 |
| 6,003,005 | A | | 12/1999 | Hirschberg | 704/260 |
| 6,081,780 | A | * | 6/2000 | Lumelsky | 704/260 |
| 6,098,041 | A | * | 8/2000 | Matsumoto | 704/260 |
| 6,173,262 | B1 | | 1/2001 | Hirschberg | |
| 6,246,672 | B1 | * | 6/2001 | Lumelsky | 370/310 |

* cited by examiner

*Primary Examiner*—Daniel Abebe
(74) *Attorney, Agent, or Firm*—Kenneth M. Brown

(57) ABSTRACT

A method and apparatus for performing text-to-speech conversion in a client/server environment partitions an otherwise conventional text-to-speech conversion algorithm into two portions: a first "text analysis" portion, which generates from an original input text an intermediate representation thereof and a second "speech synthesis" portion, which synthesizes speech waveforms from the intermediate representation generated by the first portion (i.e., the text analysis portion) The text analysis portion of the algorithm is executed exclusively on a server while the speech synthesis portion is executed exclusively on a client which may be associated therewith. The client may comprise a hand-held device such as, for example, a cell phone, and the intermediate representation of the input text advantageously comprises at least a sequence of phonemes representative of the input text. Certain audio segment information which is to be used by the speech synthesis portion of the text-to-speech process may be advantageously transmitted by the server to the client, and a cache of such audio segments may then be advantageously maintained at the client (e.g., in the cell phone) for use by the speech synthesis process in order to obtain improved quality of the synthesized speech.

46 Claims, 5 Drawing Sheets

METHOD AND APPARATUS FOR PERFORMING TEXT-TO-SPEECH CONVERSION IN A CLIENT/SERVER ENVIRONMENT

FIELD OF THE INVENTION

The present invention relates generally to the field of text-to-speech conversion systems and in particular to a method and apparatus for performing text-to-speech conversion in a client/server environment such as, for example, across a wireless network from a base station (a server) to a mobile unit such as a cell phone (a client).

BACKGROUND OF THE INVENTION

Text-to-speech systems in which input text is converted into audible human-like speech sounds have become commonly employed tools in a variety of fields such as automated telecommunications systems, navigation systems, and even in children's toys. Although such systems have existed for quite some time, over the past several years the quality of these systems has improved dramatically, thereby allowing applications which employ text-to-speech functionality to be far more than mere novelties. In fact, state-of-the-art text-to-speech systems can now automatically synthesize speech which sounds quite close to a human voice, and can do so from essentially arbitrary input text.

One well known use of text-to-speech systems is in the synthesis of speech in telecommunications applications. For example, many automated telephone response systems respond to a caller with synthesized speech automatically generated "eon the fly" from a set of contemporaneously derived text. As is well recognized by both businesses and consumers alike, the purpose of these systems is typically to provide a customer with the assistance he or she desires, but to do so without incurring the enormous cost associated with a large staff of human operators.

When telecommunications applications involving text-to-speech conversion are used in wireless (e.g., cellular phone) environments, the approach invariably employed is that the text-to-speech system resides at some non-mobile location where the input text is converted to a synthesized speech signal, and then the resultant speech signal is transmitted to the cell phone in a conventional manner (i.e., as any human speech would be transmitted to the cell phone). The central location may, for example, be a cellular base station, or it may be even further "back" in the telecommunications "chain", such as at a central location which is independent from the particular base station with which the cell phone is communicating. The conventional means of transmitting the synthesized speech to the cell phone typically involves the process of encoding the speech signal with a conventional audio coder (fully familiar to those skilled in the art), transmitting the coded speech signal, and then decoding the received signal at the cell phone.

This conventional approach, however, often leads to unsatisfactory sound quality. Speech data requires a great deal of bandwidth, and the information is subject to data loss in the wireless transmission process. Moreover, since in speech synthesis the parameters are decoded to produce a speech signal and in wireless transmission the speech is encoded and subsequently decoded for efficient transmission, there may be an incompatibility between the coding for synthesis and the coding for transmission that may introduce further degradation in the synthesized speech signal.

One theoretical alternative to the above approach might be to place the text-to-speech system on the cell phone itself, thereby requiring only the text which is to be converted to be transmitted across the wireless channel. Obviously, such text could be transmitted quite easily with minimal bandwidth requirements. Unfortunately, a high quality text-to-speech system is quite algorithmically complex and therefore requires significant processing power, which may not be available on a hand-held device such as a cell phone. And more importantly, a high quality text-to-speech system requires a relatively substantial amount of memory to store tables of data which are needed by the conversion process. In particular, present text-to-speech systems usually require between five and eighty megabytes of storage, an amount of memory which is obviously impractical to be included on a hand-held device such as a cell phone, even with today's state-of-the-art memory technology. Therefore, another more practical approach is needed to improve the quality of text-to-speech in wireless applications.

SUMMARY OF THE INVENTION

In accordance with the principles of the present invention, a method and apparatus for performing text-to-speech conversion in a client/server environment advantageously partitions an otherwise conventional text-to-speech conversion algorithm into two portions: a first "text analysis" portion, which generates from an original input text an intermediate representation thereof, and a second "speech synthesis" portion, which synthesizes speech waveforms from the intermediate representation generated by the first portion (i.e., the text analysis portion). Moreover, in accordance with the principles of the present invention, the text analysis portion of the algorithm is executed exclusively on a server while the speech synthesis portion is executed exclusively on a client which may be associated therewith. In accordance with certain illustrative embodiments of the present invention, the client may comprise a hand-held device such as, for example, a cell phone.

In accordance with various illustrative embodiments of the present invention,the intermediate representation of the input text advantageously comprises at least a sequence of phonemes representative of the input text. In addition, phoneme duration information and/or phoneme pitch information for the speech to be synthesized may be advantageously determined either at the server (i.e., as part of the text analysis portion of the partitioned text-to-speech system) or at the client (i.e., as part of the speech synthesis portion of the partitioned text-to-speech system). Similarly, other prosodic information which may be employed by the speech synthesis process may be alternatively determined by either of these two partitions.

And also, in accordance with one illustrative embodiment of the present invention, certain audio segment information which is to be used by the speech synthesis,portion of the text-to-speech process may be advantageously transmitted by the server to the client, and a cache of such audio segments may then be advantageously maintained at the client (e.g., in the cell phone) for use by the speech synthesis process in order to obtain improved quality of the synthesized speech. The server may also advantageously maintain a model of said client cache in order to keep track of its contents over time.

DETAILED DESCRIPTION

Overview of Certain Advantages of the Present Invention

By partitioning a text-to-speech system in accordance with the principles of the present invention and thereby transmitting a more compact representation of the speech (i.e., phonemes and possibly pitch and duration information as well) rather than the corresponding audio itself, better audio quality is achieved. For example, the audio can be advantageously generated with full fidelity (e.g., with a bandwidth of 7 kilohertz or more) even over a low bit rate wireless link.

As a secondary advantage, transmitting the phoneme sequence allows the communications link to be much more resistant to errors and dropouts in the audio channel. This results from the fact that the phoneme sequence has a much lower data rate than the corresponding audio signal (even compared to an audio signal that has been coded and compressed). The compact nature of the phoneme string allows time for the data to be sent with more error correction information, and also may advantageously allow time for missing sections to be retransmitted before they need to be converted to speech. For example, a phoneme sequence can typically be sent with a data rate of approximately 100 bits per second. Assuming, for example, a wireless link with a data rate of 9600 bits per second, the phoneme sequence for a 2 second utterance can usually be transmitted in less than 0.1 second, thus leaving plenty of time to retransmit information that may have been received incorrectly (or not received at all).

A Prior Art Text-to-speech System

Figure 1:
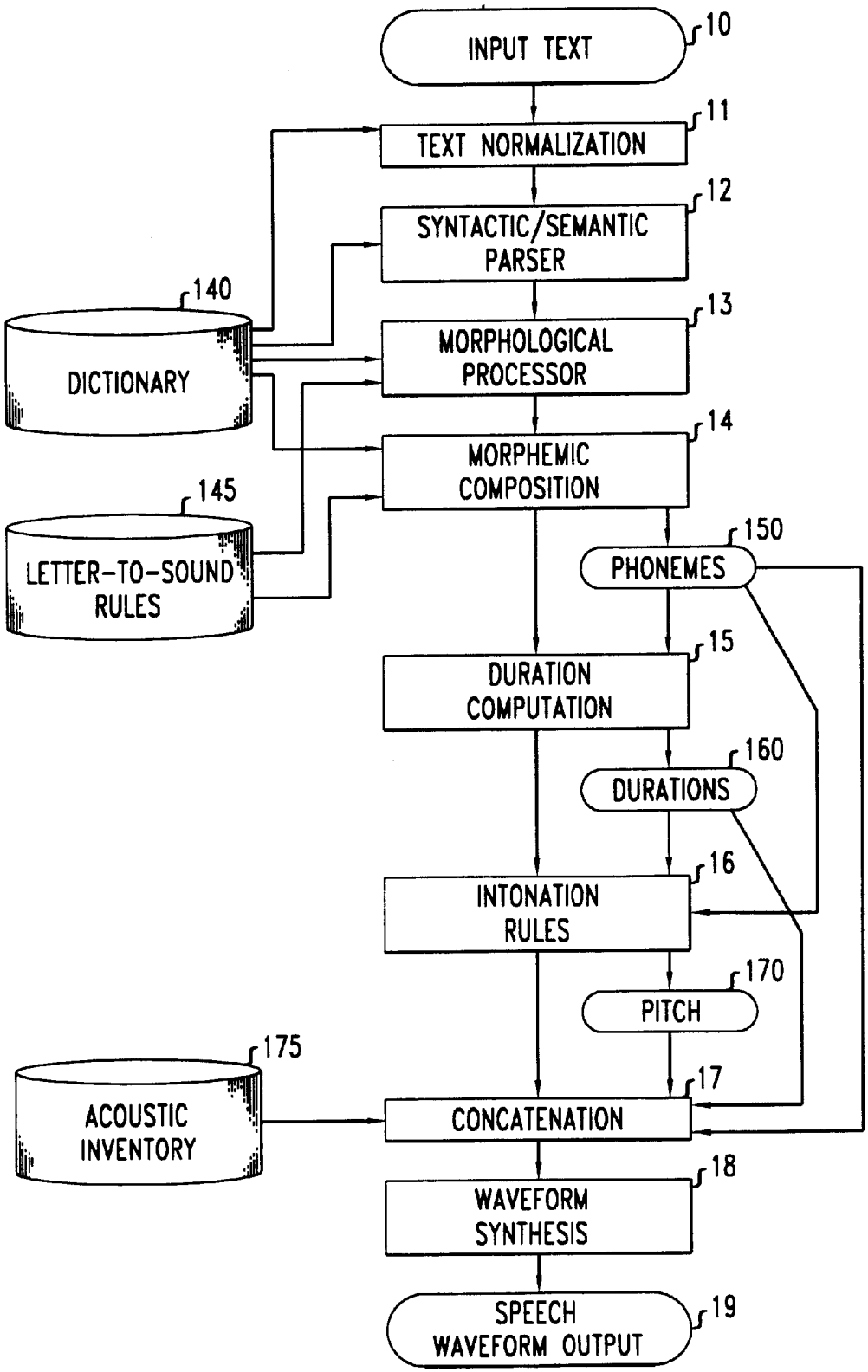
FIG. 1 (PRIOR ART)
FIG. 1 shows in detail a conventional text-to-speech system in accordance with the prior art.

FIG. 1 shows a conventional text-to-speech system in accordance with the prior art. The prior art system described in the figure converts text input 10 to a synthesized speech waveform output 19 by executing a sequence of modules in series. In some conventional text-to-speech systems, the text input 10 may be advantageously annotated for purposes of improved quality of text-to-speech conversion. (The use of such annotated text by a text-to-speech system is conventional and will be fully familiar to those skilled in the text-to-speech art.) Each of the modules shown in FIG. 1 is conventional and will be fully familiar (both in concept and in operation) to those of ordinary skill in the text-to-speech art. Nonetheless, a brief description of the operation of the prior art text-to-speech system of FIG. 1 will be provided herein for purposes of simplifying the description of the illustrative embodiments of the present invention which follows.

First, text normalization module 11 performs normalization of the text input 10. For example, if the sentence "Dr. Smith lives at 111 Smith Dr." were the input text to be converted, text normalization module 11 would resolve the issue of whether "Dr," represents the word "Doctor" or the word "Drive" in each instantiation thereof, and would also resolve whether "111" should be expressed as one "eleven" or "one hundred and eleven". Similarly, if the input text included the string "2/5", it would need to resolve whether the text represented "two fifths" or either "the fifth of February" or "the second of May". In each case, these potential ambiguities are resolved based on their context. The text normalization process as performed by text normalization module 11 is fully familiar to those skilled in the text-to-speech art.

Next, syntactic/semantic parser 12 performs both the syntactic and semantic parsing of the text as normalized by text normalization module 11. For example, in the above-referenced sample text ("Dr. Smith lives at 111 Smith Dr."), the sentence must be parsed such that the word "lives" is recognized as a verb rather than as a noun. In addition, phrase focus and pauses may also be advantageously determined by syntactic/semantic parser 12. The syntactic and semantic parsing process as performed by syntactic/semantic parser 12 is fully familiar to those skilled in the text-to-speech art.

Morphological processor 13 resolves issues relating to word formations, such as, for example, recognizing that the word "dogs" represents the concatenation of the word "dog" and a plural-forming "s". And morphemic composition module 14 uses dictionary 140 and letter-to-sound rules 145 to generate the sequence of phonemes 150 which are representative of the original input text. Both the morphological processing as performed by morphological processor 13 and the morphemic composition as performed by morphemic composition module 14 are fully familiar to those skilled in the text-to-speech art. Note that the amount of (permanent) storage required for the combination of dictionary 140 and letter-to-sound rules 145 may be quite substantial, typically falling in the range of 5–80 megabytes.

Once the sequence of phonemes 150 have been generated, duration computation module 15 determines the time durations 160 which are to be associated with each phoneme for the upcoming speech synthesis. And intonation rules processing module 16 determines the appropriate intonations, thereby determining the appropriate pitch levels 170 which are to be associated with each phoneme for the upcoming speech synthesis. (In general, intonation rules processing module 15 may also compute other prosodic information in addition to pitch levels, such as, for example, amplitude and spectral tilt information as well.) Both the duration computation process as performed by duration computation module 15 and the intonation rules processing as performed, by intonation rules processing module 16 are fully familiar to those skilled in the text-to-speech art.

Then, concatenation module 17 assembles the sequence of phonemes 150, the determined time durations 160 associated therewith, and the determined pitch levels 170 associated therewith (as well as any other prosodic information which may have been generated by, for example, intonation rules processing module 16). Specifically, concatenation module 17 makes use of at least an acoustic inventory database 1 75, which defines the appropriate speech to be generated for the sequence of phonemes. For example, acoustic inventory 175 may in particular comprise a set of diphones, which define the speech to be generated for each possible pair of successive phonemes (i.e., each possible phoneme-to-phoneme transition of the given language). The concatenation process as performed by concatenation module 17 is fully familiar to those skilled in the text-to-speech art. Note that the amount of (permanent) storage typically required for the acoustic inventory database 175 can be reasonably small—usually about 700 kilobytes. However, certain text-to-speech systems that select from multiple copies of acoustic units in order to improve speech quality can require much larger amounts of storage.

And finally, waveform synthesis module 18 uses the results of concatenation module 17 to generate the actual speech waveform output 19, which output provides a spoken representation of the text as originally input to the system (and as annotated, if applicable). Again, the waveform synthesis process as performed by waveform synthesis module 18 is conventional and will be fully familiar to those skilled in the text-to-speech art.

A Text-to-speech System According to a First Illustrative Embodiment

Figure 2:
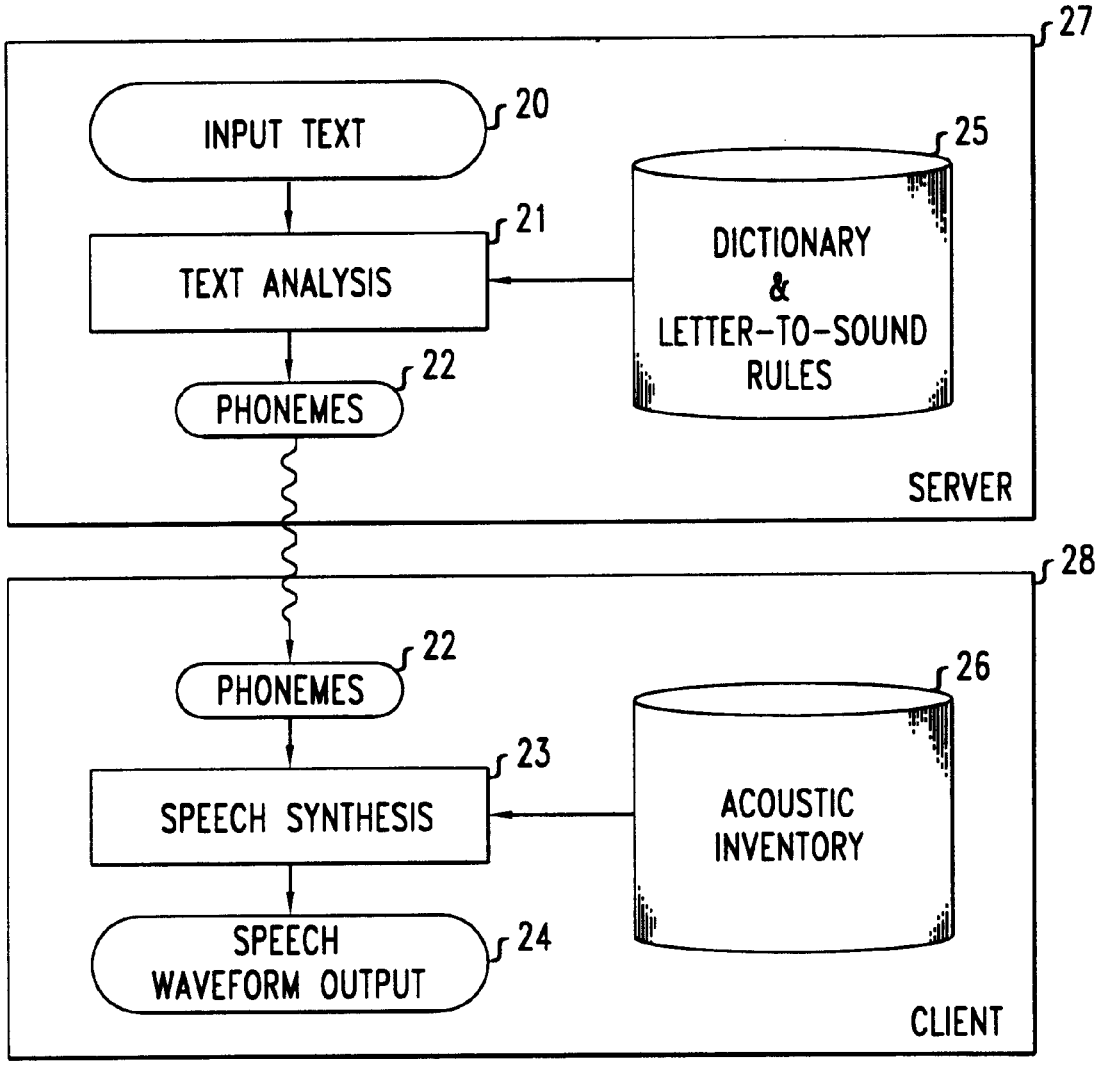
FIG. 2 shows a text-to-speech system which has been partitioned into a text analysis module for execution on a server and a speech synthesis module for execution on a client in accordance with a first illustrative embodiment of the present invention.

FIG. 2 shows an overview of a text-to-speech system which has been partitioned into a text analysis module for execution on a server and a speech synthesis module for execution on a client in accordance with a first illustrative embodiment of the present invention. In certain illustrative embodiments of the present invention the client may be a wireless device such as, for example, a cell phone.

In particular, the illustrative system of FIG. 2 comprises a text analysis module 21 which takes input text 20 (which text may be advantageously annotated), and produces at least a sequence of phonemes 22 therefrom. In particular, text analysis module 21 is executed on a server system 27, which may, for example, be located at a cellular telephone network base station, or, similarly, may be located elsewhere within the non-mobile portion of a cellular or wireless telecommunications system. Text analysis module 21 advantageously makes use of a database 25 which comprises a dictionary and a set of letter-to-sound rules, such as those described above in connection with the prior art text-to-speech system of FIG. 1.

Although not explicitly shown in the figure, text analysis module 21 may advantageously comprise a text normalization module such as text normalization module 11 as shown in FIG. 1; a syntactic/semantic parser such as syntactic/semantic parser 12 as shown in FIG. 1; a morphological processor such as morphological processor 13 as shown in FIG. 1; and a morphemic composition module such as morphemic composition module 14 as shown in FIG. 1. Database 25 may specifically comprise a dictionary such as dictionary 140 as shown in FIG. 1 and a set of letter-to-sound rules such as letter-to-sound rules 145 as shown in FIG. 1.

In accordance with the first illustrative embodiment of the present invention as shown in FIG. 2, the sequence of phonemes 22 produced by text analysis module 21 is provided (e.g., transmitted across a wireless transmission channel) to a client device 28, which may, for example, comprise a cell phone or other wireless, mobile device. In accordance with certain illustrative embodiments of the present invention, the sequence of phonemes 22 may first be advantageously encoded for purposes of efficient and/or error-resistant transmission.

The illustrative system of FIG. 2 further comprises a speech synthesis module 23 which generates a speech waveform output 24 from the sequence of phonemes 22 provided thereto (e.g., received from a wireless transmission channel). In accordance with the principles of the present invention, speech synthesis module 23 is in particular executed on client device 28 (e.g., a cell phone or other wireless device). Speech synthesis module 23 advantageously makes use of a database 26 which comprises an acoustic inventory such as is described above in connection with the prior art text-to-speech system of FIG. 1.

Although not explicitly shown in the figure, speech synthesis module 23 may advantageously comprise a duration computation module such as duration computation module 15 as shown in FIG. 1; an intonation rules processing module such as intonation rules processing module 16 as shown in FIG. 1; a concatenation module such as concatenation module 17 as shown in FIG. 1; and a waveform synthesis module such as waveform synthesis module 18 as shown in FIG. 1. Database 26 may specifically comprise an acoustic inventory database such as acoustic inventory 175 as shown in FIG. 1.

Note that, as pointed out above, whereas database 25, which is included on server 27, typically requires a substantial amount of storage (e.g., 5–80 megabytes), database 26, on the other hand, which is located on client device 28, may require a substantially more modest amount of storage (e.g., approximately 700 kilobytes). Moreover, note that in a wireless environment, for example, the transmission of a sequence of phonemes requires only a modest bandwidth as compared to the bandwidth that would be required for the transmission of the corresponding resultant speech waveform which is generated therefrom. In particular, transmission of a phoneme sequence is likely to require a bandwidth of only approximately 80–100 bits per second, whereas the transmission of a speech waveform typically requires a bandwidth in the range of 32–64 kilobits per second,(or approximately 19.2 kilobits per second if, for example, the data is compressed in a conventional manner which is typically employed in cell phone operation).

A Text-to-speech System According to a Second Illustrative Embodiment

Figure 3:
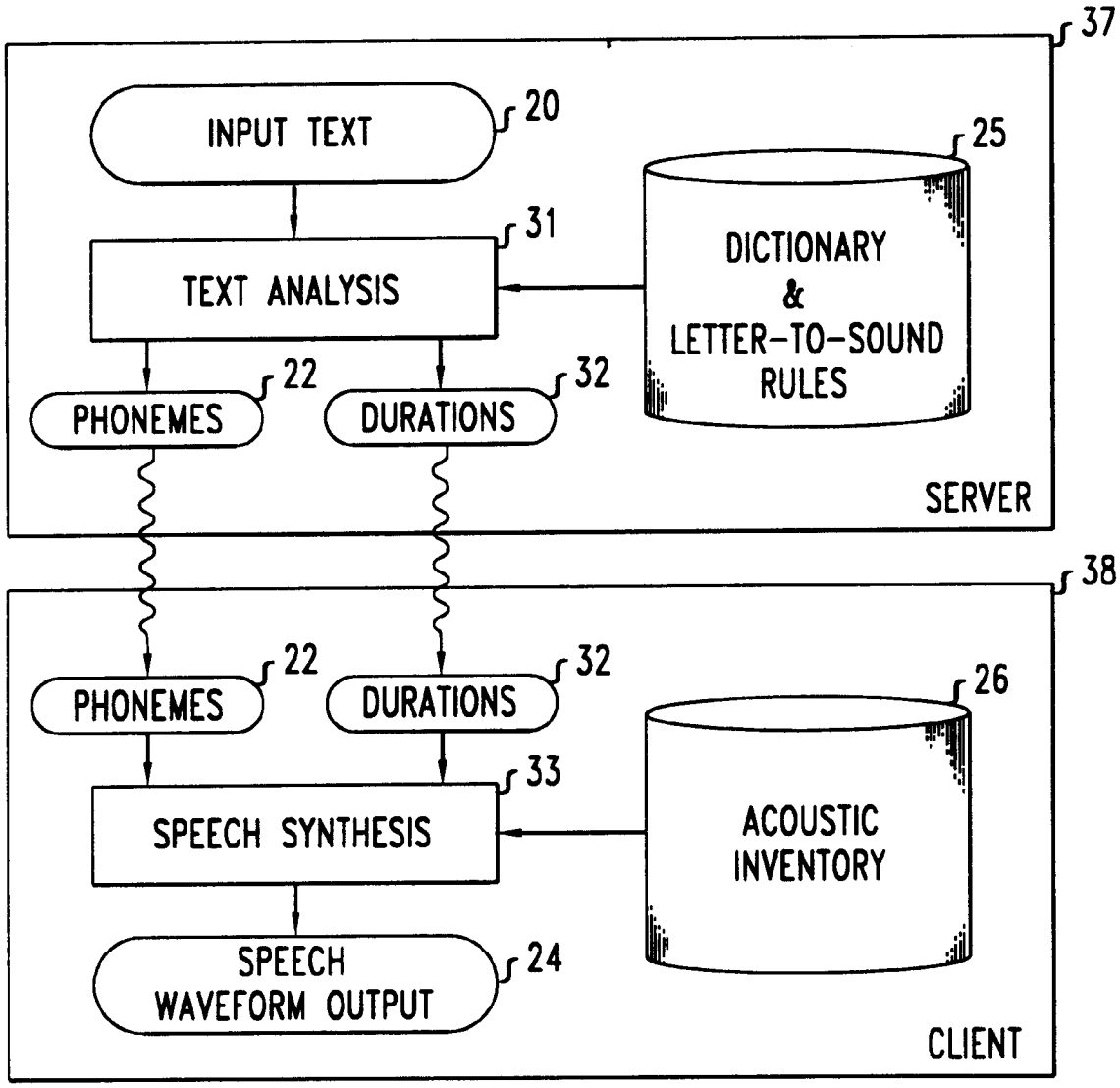
FIG. 3 shows a text-to-speech system which has been partitioned into a text analysis module for execution on a server and a speech synthesis module for execution on a client in accordance with a second illustrative embodiment of the present invention.

FIG. 3 shows an overview of a text-to-speech system which has been partitioned into a text analysis module for execution on a server and a speech synthesis module for execution on a client in accordance with a second illustrative embodiment of the present invention. The illustrative system of FIG. 3 is similar to the illustrative system of FIG. 2 except that durations corresponding to the sequence of phonemes generated by the text analysis module of the illustrative system of FIG. 2 are also derived within the text analysis module of the illustrative system of FIG. 3. In certain illustrative embodiments of the present invention the client may be a wireless device such as, for example, a cell phone.

In particular, the illustrative system of FIG. 3 comprises a text analysis module 31 which takes input text 20 (which text may be advantageously annotated), and produces both a sequence of phonemes 22 and also a set of corresponding durations 32 therefrom. In particular, text analysis module 31 is executed on a server system 37, which may, for example, be located at a cellular telephone network base station, or, similarly, may be located elsewhere within the non-mobile portion of a cellular or wireless telecommunications system. Text analysis module 31 advantageously makes use of a database 25 which comprises a dictionary and a set of letter-to-sound rules, such as those described above in connection with the prior art text-to-speech system of FIG. 1.

Although not explicitly shown in the figure, text analysis module 31 may advantageously comprise a text normalization module such as text normalization module 11 as shown in FIG. 1; a syntactic/semantic parser such as syntactic/semantic parser 12 as shown in FIG. 1; a morphological processor such as morphological processor 1 as shown in FIG. 1; a morphemic composition module such as morphemic composition module 14 as shown in FIG. 1; and a duration computation module such as duration computation module 15 as shown in FIG. 1. Database 25 may specifically comprise a dictionary such as dictionary 140 as shown in FIG. 1 and a set of letter-to-sound rules such as letter-to-sound rules 145 as shown in FIG. 1.

In accordance with the second illustrative embodiment of the present invention as shown in FIG. 3, the sequence of phonemes 22 and the set of corresponding durations 32 produced by text analysis module 31 are provided (e.g., transmitted across a wireless transmission channel) to a client device 38, which may, for example, comprise a cell phone or other wireless, mobile device. In accordance with certain illustrative embodiments of the present invention, the sequence of phonemes 22 and/or the set of corresponding durations 32 may first be advantageously encoded for purposes of efficient and/or error-resistant transmission.

The illustrative system of FIG. 3 further comprises a speech synthesis module 33 which generates a speech waveform output 24 from the sequence of phonemes 22 and the set of corresponding durations 32 provided thereto (e.g., received from a wireless transmission channel). In accordance with the principles of the present invention, speech synthesis module 33 is in particular executed on client device 38 (e.g., a cell phone or other wireless device). Speech synthesis module 33 advantageously makes use of a database 26 which comprises an acoustic inventory such as is described above in connection with the prior art text-to-speech system of FIG. 1.

Although not explicitly shown in the figure, speech synthesis module 33 may advantageously comprise an intonation rules processing module such as intonation rules processing module 16 as shown in FIG. 1; a concatenation module such as concatenation module 17 as shown in FIG. 1; and a waveform synthesis module such as waveform synthesis module 18 as shown in FIG. 1. Database 26 may specifically comprise an acoustic inventory database such as acoustic inventory 175 as shown in FIG. 1.

Note that, as pointed out above, whereas database 25, which is included on server 37, typically requires a substantial amount of storage (e.g., 5–80 megabytes), database 26, on the other hand, which is located on client device 38, may require a substantially more modest amount of storage (e.g., approximately 700 kilobytes). Moreover, note that in a wireless environment, for example, the transmission of a sequence of phonemes in combination with the set of corresponding durations requires only a modest bandwidth as compared to the bandwidth that would be required for the transmission of the corresponding resultant speech waveform which is generated therefrom. In particular, transmission of the phoneme sequence and the corresponding durations is likely to require a bandwidth of only approximately 120–150 bits per second, while the transmission of a speech waveform typically requires a bandwidth in the range of 32–64 kilobits per second (or approximately 19.2 kilobits per second if, for example, the data is compressed in a conventional manner which is typically employed in cell phone operation).

A Text-to-speech System According to a Third Illustrative Embodiment

Figure 4:
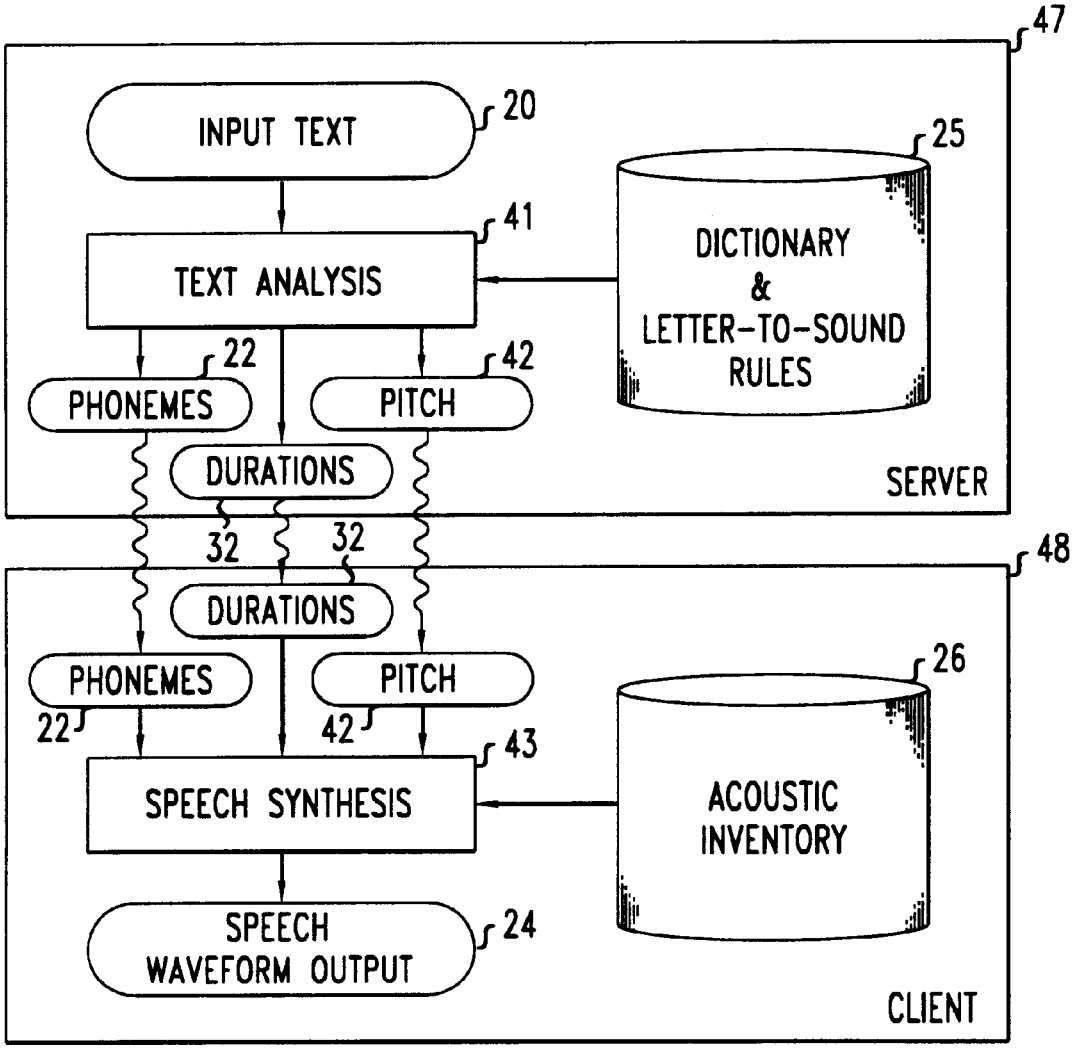
FIG. 4 shows a text-to-speech system which has been partitioned into a text analysis module for execution on a server and a speech synthesis module for execution on a client in accordance with a third illustrative embodiment of the present invention.

FIG. 4 shows an overview of a text-to-speech system which has been partitioned into a text analysis module for execution on a server and a speech synthesis module for execution on a client in accordance with a third illustrative embodiment of the present invention. The illustrative system of FIG. 4 is similar to the illustrative system of FIG. 3 except that pitch levels corresponding to the sequence of phonemes generated by the text analysis, module of the illustrative system of FIG. 3 are also derived within the text analysis module of the illustrative system of FIG. 4. In certain illustrative embodiments of the present invention the client may be a wireless device such as, for example, a cell phone.

In particular, the illustrative system of FIG. 4 comprises a text analysis module 41 which takes input text 20 (which text may be advantageously annotated), and produces a sequence of phonemes 22, a set of corresponding durations 32, and a set of corresponding pitch levels 42 therefrom. In particular, text analysis module 41 is executed on a server system 47, which may, for example, be located at a cellular telephone network, base station, or, similarly, may be located elsewhere within the nonmobile portion of a cellular or wireless telecommunications system. Text analysis module 41 advantageously makes use of a database 25 which comprises a dictionary and a set of letter-to-sound rules, such as those described above in connection with the prior art text-to-speech system of FIG. 1.

Although not explicitly shown in the figure, text analysis module 41 may advantageously comprise a text normalization module such as text normalization module 11 as shown in FIG. 1; a syntactic/semantic parser such as syntactic/semantic parser 12 as shown in FIG. 1; a morphological processor such as morphological processor 13 as shown in FIG. 1; a morphemic composition module such as morphemic composition module 14 as shown in FIG. 1; a duration computation module such as duration computation module 15 as shown in FIG. 1; and an intonation rules processing module such as intonation rules processing module 16 as shown in FIG. 1. Database 25 may specifically comprise a dictionary such as dictionary 140 as shown in FIG. 1 and a set of letter-to-sound rules such as letter-to-sound rules 145 as shown in FIG. 1.

In accordance with the third illustrative embodiment of the present invention as shown in FIG. 4, the sequence of phonemes 22, the set of corresponding durations 32 and the set of corresponding pitch levels 42 as produced by text analysis module 41 are provided (e.g., transmitted across a wireless transmission channel) to a client device 48, which may, for example, comprise a cell phone or other wireless, mobile device. In accordance with certain illustrative embodiments of the present invention, the sequence of phonemes 22, the set of corresponding durations 32, and/or the set of corresponding pitch levels 42 may first be advantageously encoded for purposes of efficient and/or error-resistant transmission.

The illustrative system of FIG. 4 further comprises a speech synthesis module 43 which generates a speech waveform output 24 from the sequence of phonemes 22, the set of corresponding durations 32, and the set of corresponding pitch levels as provided thereto (e.g., received from a wireless transmission channel). In accordance with the principles of the present invention, speech synthesis module 43 is in particular executed on client device 48 (e.g., a cell phone or other wireless device). Speech synthesis module 43 advantageously makes use of a database 26 which comprises an acoustic inventory such as is described above in connection with the prior art text-to-speech system of FIG. 1.

Although not explicitly shown in the figure, speech synthesis module 43 may advantageously comprise a concatenation module such as concatenation module 17 as shown in FIG. 1, and a waveform synthesis module such as waveform synthesis module 18 as shown in FIG. 1. Database 26 may specifically comprise an acoustic inventory database such as acoustic inventory 175 as shown in FIG. 1.

Note that, as pointed out above, whereas database 25, which is included on server 47, typically requires a substantial amount of storage (e.g., 5–80 megabytes), database 26, on the other hand, which is located on client device 48, may require a substantially more modest amount of storage (e.g., approximately 700 kilobytes). Moreover, note that in a wireless environment, for example, the transmission of a sequence of phonemes in combination with the set of corresponding durations and further in combination with the set of corresponding pitch levels requires only a modest bandwidth as compared to the bandwidth that would be required for the transmission of the corresponding resultant speech waveform which is generated therefrom. In particular, transmission of the phoneme sequence, the corresponding durations, and the corresponding pitch levels is likely to require a bandwidth of only approximately 150–350 bits per second, while the transmission of a speech waveform typically requires a bandwidth in the range of 32–64 kilobits per second (or approximately 19.2 kilobits per second if, for example, the data is compressed in a conventional manner which is typically employed in cell phone operation).

A Text-to-speech System According to a Fourth Illustrative Embodiment

Figure 5:
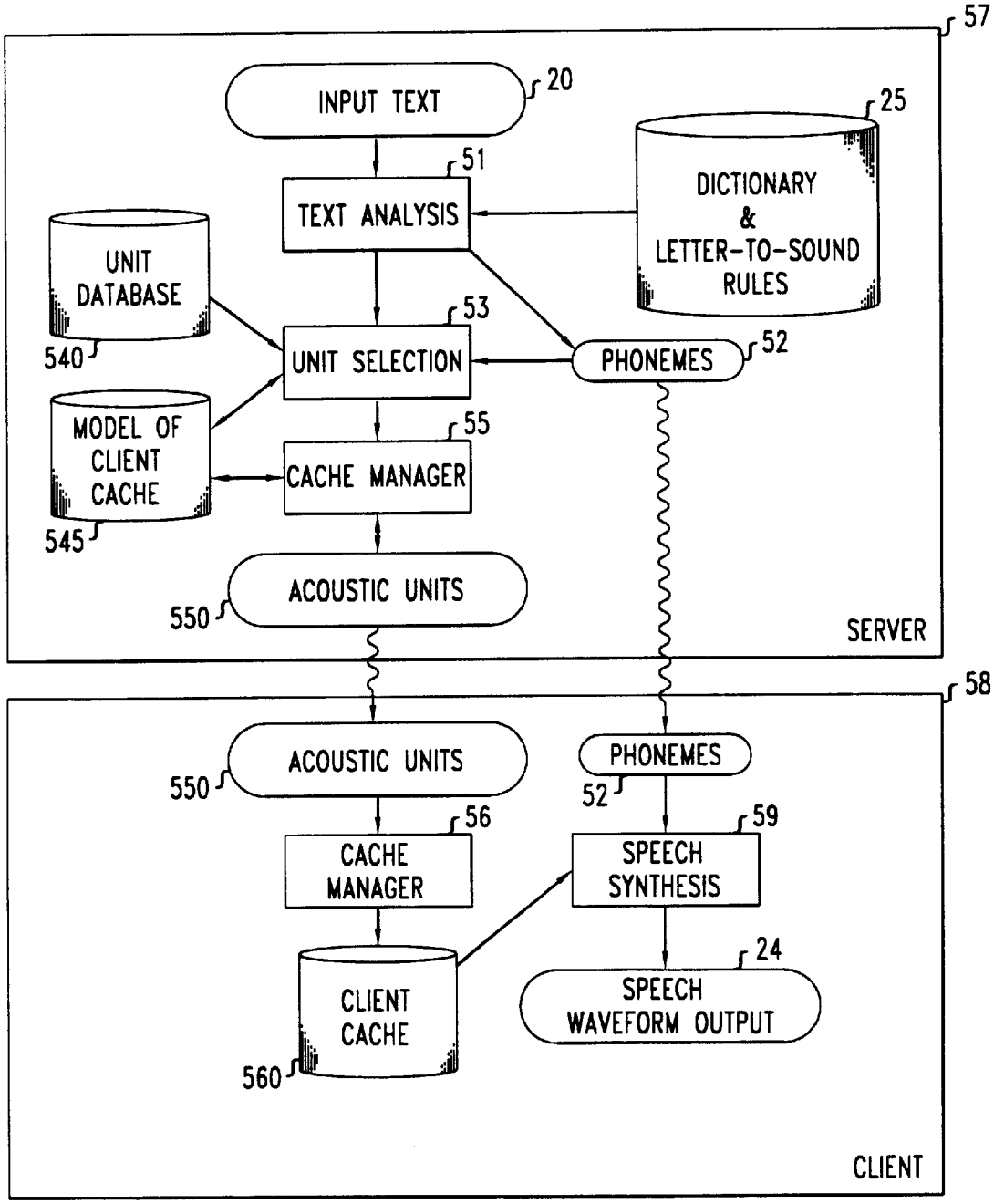
FIG. 5 shows a text-to-speech system which has been partitioned into a text analysis module for execution on a server and a speech synthesis module for execution on a client which maintains a client cache of audio segments in accordance with a fourth illustrative embodiment of the present invention.

FIG. 5 shows a text-to-speech system which has been partitioned into a text analysis module for execution on a server and a speech synthesis module for execution on a client, and which further employs a client cache of audio segments in accordance with a fourth illustrative embodiment of the present invention. The illustrative system of FIG. 5 may, for example, be similar to the illustrative system of FIGS. 2, 3, or 4, except that a cache of audio segments is advantageously employed in the client to enable the synthesis of higher quality speech without a significant increase in storage requirements therefor.

In particular, note that each of the above-described illustrative embodiments of the present invention includes a speech synthesis module which resides on a client device and which synthesizes a speech waveform by extracting selected audio segments out of its database (e.g, database 26) based on the information received from (e.g., transmitted by) a corresponding text analysis module. As is typical of what are known as "concatenative" text-to-speech systems (such as those illustratively described herein), the synthesized speech is based on such a database of speech sounds, which includes, minimally, a set of audio segments that cover all of the phoneme-to-phoneme transitions (i.e., diphones) of the given language. Clearly, any sentence of the language can be pieced together with this set of units (i.e., audio segments), and, as pointed out above, such a database will typically require less than 1 megabyte (e.g., approximately 700 kilobytes) of storage on the client device (which may, for example, be a hand-held wireless device such as a cell phone).

On the other hand, a state-of-the-art, high quality text-to-speech system typically employs an even larger database that provides much better coverage of multiple phoneme combinations, including multiple renditions of phoneme combinations with different timing and pitch information. Such a text-to-speech system can achieve natural speech quality when synthesized sentences are concatenated from long and prosodically appropriate units. The amount of storage required for such a database, however, will usually be quite a bit larger than that which could be accommodated in a typical hand-held device such as a cell phone.

The speech database of such a high quality text-to-speech system is quite large because it advantageously covers all possible combinations of speech sounds. But in actual operation, text-to-speech systems typically synthesize one sentence at a time, for which only a very small subset of the database needs to be selected in order to cover the given phoneme sequence, along with other information, such as prosodic information. The selected section of speech may then be advantageously processed to reduce perceptual discontinuities between this segment and the neighboring segments in the output speech stream. The processing also can be advantageously used to adjust for pitch, amplitude, and other prosodic variations.

As such, in accordance with a fourth illustrative embodiment of the present invention, several techniques are advantageously employed in order to allow a large database-based text-to-speech system to operate in a server/client partitioned manner, where, the client is a relatively small device such as, for example, a cell phone. First, the client (e.g., cell phone) advantageously contains a cache of audio segments. For example, the cache may contain a permanent set of audio segments that cover all phoneme transitions of the given language, as well as a small set of commonly used segments. This will guarantee that the text-to-speech system on the cell phone will be able to synthesize any sentence without the need to rely on any additional audio segments (that it may not have).

However, to deliver a high quality text-to-speech system within the memory constraint of, for example, a cell phone, additional audio segments that may be used to produce better quality speech may then be advantageously transmitted from the server to the client as needed. These are typically longer and prosodically more appropriate segments that are not already in the client's cache, but that can be nonetheless transmitted from the server to the cell phone in time to synthesize the requested sentence. Acoustic units (i.e., audio segments) that are already in the client cache obviously do not have to be transmitted. Acoustic units that are not needed for the given sentence also do not need to be transmitted. This strategy keeps the cache on the client relatively small, and further advantageously keeps the transmission volume low.

Second, the server end advantageously tracks the contents of the client cache by maintaining a "model" of the client cache which keeps track of the audio segments which are in the client cache at any given time. On connection, or on request, the client would advantageously list the contents of its cache to allow the server to initialize its model. The server would then transmit audio segments to the cell phone as needed, so that the necessary segments would be in the cache before they are required for speech synthesis. Note that in the case where the cache is very small (as compared to the total of all audio segments that are used), the server may need to advantageously optimize the time at which segments are transmitted to ensure that one necessary segment doesn't bump some other necessary segment out of the cache.

Third, the server may advantageously consider the contents of the client cache in its segment selection process. That is, it may at times be advantageous to intentionally select a segment that is not optimal (from a perceptual point of view), in order to ensure that the data link is not overloaded or in order to ensure that the client cache does not overflow.

And fourth, since the server knows which segments are in the client cache, it can transmit new segments in a compressed form, making use of the common information at both ends. For example, if a segment is a small variation on a segment already in the client cache, it might advantageously be transmitted in the form of a reference to an existing cache item plus difference information.

Specifically then, referring to FIG. 5, the fourth illustrative embodiment of the present invention advantageously employs a client maintained cache of audio segments as described above. In particular, the illustrative system of FIG. 5 comprises a text analysis module 51, a unit selection module 53 and a cache manager 55, which are executed on a server system 57. Text analysis module 51 takes input text 20 (which text may be advantageously annotated) and produces a sequence of phonemes 52. (Phonemes 52 may, in certain illustrative embodiments, also include corresponding duration and pitch information, and possibly other prosodic information as well.) Text analysis module 51 advantageously makes use of a database 25 which comprises a dictionary and a set of letter-to-sound rules, such as those described above in connection with the prior art text-to-speech system of FIG. 1. Unit selection module 53 and cache manager 55 make use of unit database 540 which includes acoustic units that may be provided to the client cache. In addition, cache manager 55 maintains a model of the client cache 545, and based on this model and on the selections made from unit database 540 by unit selection module 53, cache manager 55 determines which (additional) acoustic units 550 are to be provided (e.g., transmitted) to the client. (Note also that in certain situations cache manager 55 may determine that it would be advantageous to remove one or more acoustic units from the client cache. In such a case, acoustic units 550 may include a directive to remove one or more acoustic units from the client cache.)

Although riot explicitly shown in the figure, text analysis module 51 may advantageously comprise a text normalization module such as text normalization module 11 as shown in FIG. 1; a syntactic/semantic parser such as syntactic/semantic parser 12 as shown in FIG. 1; a morphological processor such as morphological processor 13 as shown in FIG. 1; and a morphemic composition module such as morphemic composition module 14 as shown in FIG. 1. (In accordance with some illustrative embodiments, text analysis module 51 may also advantageously comprise a duration computation module such as duration computation module 15 as shown in FIG. 1 and/or an intonation rules processing module such as intonation rules processing module 16 as shown in FIG. 1.) Database 25 may specifically comprise a dictionary such as dictionary 140 as shown in FIG. 1 and a set of letter-to-sound rules such as letter-to-sound rules 145 as shown in FIG. 1.

In accordance with the fourth illustrative embodiment of the present invention as shown in FIG. 5, the sequence of phonemes 52 (which may include corresponding durations and/or corresponding pitch levels as well) as produced by text analysis module 51 is provided (e.g., transmitted across a wireless transmission channel) to a client device 58, which may, for example, comprise a cell phone or other wireless, mobile device. In accordance with certain illustrative embodiments of the present invention, the sequence of phonemes 52 may first be advantageously encoded for purposes of efficient and/or error-resistant transmission.

The illustrative system of FIG. 5 further comprises a speech synthesis module 59 which generates a speech waveform output 24 from the sequence of phonemes 52 as provided thereto (e.g., received from a wireless transmission channel), and also further comprises a cache manager 56 which receives any transmitted acoustic units 550 for inclusion in client cache 560. (As pointed out above, acoustic units 550 may also, in some cases, include a directive to cache manager 56 to remove one or more acoustic units from client cache 560.) In one illustrative embodiment of the present invention, cache manager 56 of client device 58 may perform a reverse handshake to server 57 in order to indicate whether a particular acoustic unit was successfully transferred over the transmission link.

Speech synthesis module 59 advantageously generates the speech waveform output 24 by making use of client cache 560, which advantageously contains both an "initial" set of acoustic units (such as those contained in database 26 as described above in connection with the prior art text-to-speech system of FIG. 1), and also a set of additional acoustic units which may be advantageously used for the generation of higher quality speech.

In one illustrative embodiment of the present invention, the initial diphone inventory may be advantageously chosen based on a predetermined frequency distribution, and thereby may include less than all of the diphones of the given language. In this manner, the size of the client cache 560 may be advantageously reduced even further. Note that at least some of the additional acoustic units may have been added to client cache 560 by cache manager 56 in response to the receipt of transmitted acoustic units 550 for inclusion therein. In accordance with the principles of the present invention, speech synthesis module 59 and cache manager 56 are in particular executed on client device 58 (e.g., a cell phone or other wireless device).

Although not explicitly shown in the figure, speech synthesis module 59 may advantageously comprise a concatenation module such as concatenation module 17 as shown in FIG. 1, and a waveform synthesis module such as waveform synthesis module 18 as shown in FIG. 1. (In accordance with some illustrative embodiments, speech synthesis module 59 may also advantageously comprise an intonation rules processing module such as intonation rules processing module 16 and/or a duration computation module such as duration computation module 15 as shown in FIG. 1.) Client cache 560 may specifically include, as at least a portion of its "initial" contents, an acoustic inventory database such as acoustic inventory 175 as shown in FIG. 1.

Additional Illustrative Embodiments and Addendum to the Detailed Description

It should be noted that all of the preceding discussion merely illustrates the general principles of the invention. It will be appreciated that those skilled in the art will be able to devise various other arrangements which, although not explicitly described or shown herein, embody the principles of the invention and are included within its spirit and scope. For example, although the above discussion has focused primarily on an application of the invention to wireless (e.g., cellular) telecommunications (wherein the client may, for example be a hand-held wireless device such as a cell phone), it will be obvious to those skilled in the art that the invention may be applied in many other applications where a text-to-speech conversion process may be advantageously partitioned into multiple portions (e.g., a text analysis portion and a speech synthesis portion) which may advantageously be executed at different locations and/or at different times.

Such alternative applications include, for example, other (i.e., non-wireless) communications environments and scenarios as well as numerous applications not typically thought of as involving communications per se. More particularly, the client device may be any speech producing device or system wherein the text to be converted to speech has been provided at an earlier time and/or at a different location. By way of just one illustrative example, note that many children's toys produce speech based on text which has been previously provided "at the factory" (i.e., at the time and place of manufacture). In such a case, and in accordance with one illustrative embodiment of the present invention, the text analysis portion of a text-to-speech conversion process may be performed "at the factory" (on a "server" system), and the prosodic information (e.g., phoneme sequences and, possibly, associated duration and pitch information as well) may be provided on a portable memory storage device, such as, for example, a floppy disk or a semiconductor (RAM) memory device, which is then inserted into the toy (i.e., the client device). Then, the speech synthesis portion of the text-to-speech process may be efficiently performed on the toy when called upon by the user.

As a further illustrative example, note that a system designed to synthesize speech from an e-mail message may also advantageously make use of the principles of the present invention. In particular, a server (e.g., a system from which an e-mail has been sent) may execute the text analysis portion of a text-to-speech system on the text contained in the e-mail, while a client (e.g., a system at which the e-mail is received) may then subsequently execute the speech synthesis portion of the text-to-speech system at a later time. In accordance with the principles of the present invention as applied to such an application, the intermediate representation of the e-mail text may be transmitted from the server system to the client system either in place of, or, alternatively, in addition to the e-mail text itself. For example, the text analysis portion of the text-to-speech system may be performed at a time when the e-mail message is initially composed, while the speech synthesis portion may not be performed until the e-mail is later accessed by the intended recipient.

Furthermore, all examples and conditional language recited herein arc principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future—i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown.

The functions of the various elements shown in the figures, including functional blocks labeled as "processors" or "modules" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read-only memory (ROM) for storing software, random access memory (RAM), and non-volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof any element expressed as a means for performing a specified function is intended to encompass any way of performing that function including, for example (a) a combination of circuit elements which performs that function or (b) software in any form, including, therefore firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent (within the meaning of that term as used in 35 U.S.C. 112, paragraph 6) to those explicitly shown and described herein.

We claim:

1. A method for performing text-to-speech conversion comprising the steps of:

analyzing input text and producing therefrom an intermediate representation thereof; and synthesizing speech output based upon said intermediate representation of said input text, wherein said analyzing and producing step is performed on a server within a client/server environment, and wherein said synthesizing step is performed on a client device which is associated with but distinct from said server, wherein said synthesizing step produces said speech output further based upon a set of acoustic units comprised in a dynamic cache memory associated with said client device, the method further comprising the steps of:

selecting a subset of acoustic units from an acoustic unit database associated with said server, wherein said subset of acoustic units is selected based on said intermediate representation of said input text and on a determination of which acoustic units will be needed and which acoustic units will not be needed to synthesize the speech output from the intermediate representation of said input text;

transmitting one or more of said acoustic units comprised in said Subset across a communications channel from said server to said client device; and storing said one or more of said acoustic units in said dynamic cache memory.

2. The method of claim 1 further comprising the step of transmitting said intermediate representation of said input text across a communications channel from said server to said client device.

3. The method of claim 2 wherein said communications channel comprises a wireless communications channel and wherein said client device comprises a wireless communications device.

4. The method of claim 3 wherein said client device comprises a cell phone.

5. The method of claim 1 wherein said one or more of said acoustic units which are transmitted from said server system to said client system are determined based on a model of said cache memory associated with said client device which is maintained in association with said server.

6. The method of claim 1 further comprising the step of storing said intermediate representation of said input text on a storage device and wherein said synthesizing step retrieves said intermediate representation of said input text from'said storage device.

7. The method of claim 6 wherein said intermediate representation of said input text comprises at least a representation of a sequence of phonemes representative of said input text.

8. The method of claim 7 wherein said intermediate representation further comprises one or more acoustic units.

9. The method of claim 1 wherein said input text comprises e-mail and wherein said synthesizing step is performed upon access of said e-mail by an intended recipient thereof.

10. The method of claim 1 wherein said intermediate representation of said input text comprises at least a representation of a sequence of phonemes representative of said input text.

11. The method of claim 10 wherein said intermediate representation of said input text further comprises a set of corresponding time durations associated with said sequence of phonemes.

12. The method of claim 10 wherein said intermediate representation of said input text further comprises a set of corresponding pitch levels associated with said sequence of phonemes.

13. A method for performing a second portion of a text-to-speech conversion process, the method executed on a client device within a client/server environment and comprising the step of synthesizing speech output based upon an intermediate representation of input text, said intermediate representation of said input text having been produced by a first portion of said text-to-speech conversion process executed on a server which is associated with but distinct from said client device, wherein said synthesizing step produces said speech output further based upon a set of acoustic units comprised in a dynamic cache memory associated with said client device, the method further comprising the steps of:

receiving one or more acoustic units which have been selected from an acoustic unit database associated with said server and transmitted across a communications channel from said server to said client device, wherein said subset of acoustic units were selected based on said intermediate representation of said input text and on a determination of which acoustic unit will be needed and which acoustic units will not be needed to synthesize the speech output from the intermediate representation of said input text; and storing said one or more acoustic units in said dynamic cache memory.

14. The method of claim 13 further comprising the step of receiving said intermediate representation of said input text across a communications channel, said intermediate representation of said input text having been transmitted from said server to said client device.

15. The method of claim 14 wherein said communications channel comprises a wireless communications channel and wherein said client device comprises a wireless communications device.

16. The method of claim 15 wherein said client device comprises a cell phone.

17. The method of claim 13 wherein said intermediate representation of said input text has been stored on a storage device, and wherein said synthesizing step retrieves said intermediate representation of said input text from said storage device.

18. The method of claim 17 wherein said intermediate representation of said input text comprises at least a representation of a sequence of phonemes representative of said input text.

19. The method of claim 18 wherein said intermediate representation further comprises one or more acoustic units.

20. The method of claim 13 wherein said input text comprises e-mail and wherein said synthesizing step is performed upon access of said e-mail by an intended recipient thereof.

21. The method of claim 13 wherein said intermediate representation of said input text comprises a representation of at least a sequence of phonemes representative of said input text.

22. The method of claim 21 wherein said intermediate representation of said input text further comprises a set of corresponding time durations associated with said sequence of phonemes.

23. The method of claim 21 wherein said intermediate representation of said input text further comprises a set of corresponding pitch levels associated with said sequence of phonemes.

24. A system for performing text-to-speech conversion comprising:

a text analysis module which analyzes input text and produces therefrom an intermediate representation thereof; and a speech synthesis module which synthesizes speech output based upon said intermediate representation of said input text, wherein said text analysis module resides on a server within a client/server environment, and wherein said speech synthesis module resides on a client device which is associated with but distinct from said server.

wherein said speech synthesis module produces said speech output further based upon a set acoustic units comprised in a dynamic cache memory associated with said client device, the system further comprising:

means for selecting a subset of acoustic units from an acoustic unit database associated with said server, wherein said subset of acoustic units is selected based on said intermediate representation of said input text and on a determination of which acoustic units will be needed and which acoustic units will not be needed to synthesize the speech output from the intermediate representation of said input text;

means for transmitting one or more of said acoustic units across a communications channel from said server to said client device; and means for storing said one or more acoustic units in said dynamic cache memory.

25. The system of claim 24 further comprising means for transmitting said intermediate representation of said input text across a communications channel from said server to said client device.

26. The system of claim 25 wherein said communications channel comprises a wireless communications channel and wherein said client device comprises a wireless communications device.

27. The system of claim 26 wherein said client device comprises a cell phone.

28. The system of claim 24 wherein said one or more of said acoustic units which are transmitted from said server system to said client system are determined based on a model of said cache memory associated with said client device which is maintained in association with said server.

29. The system of claim 24 further comprising means for storing said intermediate representation of said input text on a storage device and wherein said speech synthesis module retrieves said intermediate representation of said input text from said storage device.

30. The system of claim 29 wherein said intermediate representation of said input text comprises at least a representation of a sequence of phonemes representative of said input text.

31. The system of claim 30 wherein said intermediate representation further comprises one or more acoustic units.

32. The system of claim 24 wherein said input text comprises e-mail and wherein said speech synthesis module executes upon access of said e-mail by an intended recipient thereof.

33. The system of claim 24 wherein said intermediate representation of said input text comprises a representation of at least a sequence of phonemes representative of said input text.

34. The system of claim 33 wherein said intermediate representation of said input text further comprises a set of corresponding time durations associated with said sequence of phonemes.

35. The system of claim 33 wherein said intermediate representation of said input text further comprises a set of corresponding pitch level associated with said sequence of phonemes.

36. A client device within a client/server environment which performs a second portion of a text-to-speech conversion process, the client device comprising a speech synthesis module which synthesizes speech output based upon an intermediate representation of input text, said intermediate representation of said input text having been produced by a first portion of said text-to-speech conversion process executed on a server which is associated with but distinct from said client device, wherein said speech synthesis module produces said speech output further based upon a set of acoustic units comprised in a dynamic cache memory associated with said client device, the client device further comprising:

means for receiving one or more acoustic units which have been selected from an acoustic unit database associated with said server and transmitted across a communications channel from said server to said client device, wherein said subset of acoustic units was selected based on said intermediate representation of said input text and on a determination of which acoustic units will be needed and which acoustic units will not be needed to synthesize the speech output from the intermediate representation of said input text; and means for storing said one or more acoustic units in said dynamic cache memory.

37. The client device of claim 36 further comprising means for receiving said intermediate representation of said input text across a communications channel said intermediate representation of said input text having been transmitted from said server to said client device.

38. The client device of claim 37 wherein said communications channel comprises a wireless communications channel and wherein said client device comprises a wireless communications device.

39. The client device of claim 38 wherein said client device comprises a cell phone.

40. The client device of claim 36 wherein said intermediate representation of said input text has been stored on a storage device, and wherein said speech synthesis module retrieves said intermediate representation of said input text from said storage device.

41. The client device of claim 40 wherein said intermediate representation of said input text comprises at least a representation of a sequence of phonemes representative of said input text.

42. The client device of claim 41 wherein said intermediate representation further comprises one or more acoustic units.

43. The client device of claim 36 wherein said input text comprises e-mail and wherein said speech synthesis module is executed upon access of said e-mail by an intended recipient thereof.

44. The client device of claim 36 wherein said intermediate representation of said input text comprises a representation of at least a sequence of phonemes representative of said input text.

45. The client device of claim 44 wherein said intermediate representation of said input text further comprises a set of corresponding time durations associated with said sequence of phonemes.

46. The client device of claim 44 wherein said intermediate representation of said input text further comprises a set of corresponding pitch levels associated with said sequence of phonemes.

* * * * *